US007170406B2

(12) United States Patent
Seemann

(10) Patent No.: US 7,170,406 B2
(45) Date of Patent: Jan. 30, 2007

(54) DEVICE AND PROCESS FOR ENTERING OR LEAVING AN AREA IN A CONTROLLED MANNER

(75) Inventor: Günter Seemann, Palingen (DE)

(73) Assignee: Dräger Safety AG & Co. KGaA (DE)

( * ) Notice: Subject to any disclaimer, the term of this patent is extended or adjusted under 35 U.S.C. 154(b) by 289 days.

(21) Appl. No.: 10/940,525

(22) Filed: Sep. 14, 2004

(65) Prior Publication Data

US 2005/0128077 A1 Jun. 16, 2005

(30) Foreign Application Priority Data

Oct. 15, 2003 (DE) ..... 103 47 894

(51) Int. Cl.
*G08B 1/08* (2006.01)

(52) U.S. Cl. ..... 340/539.11; 340/572.2; 340/10.1

(58) Field of Classification Search ..... 340/539.11, 340/528, 506, 632, 573.1, 5.8, 5.2, 572.2, 340/541, 10.1, 686.1; 713/182
See application file for complete search history.

(56) References Cited

U.S. PATENT DOCUMENTS 5,963,134 A * 10/1999 Bowers et al. ..... 340/572.1
6,181,250 B1 * 1/2001 Brooks, Jr. ..... 340/577
6,531,963 B1 * 3/2003 Nyfelt ..... 340/573.1
6,617,970 B2 * 9/2003 Makiyama et al. ..... 340/573.1
6,873,260 B2 * 3/2005 Lancos et al. ..... 340/573.1
2003/0197612 A1 * 10/2003 Tanaka et al. ..... 340/572.1
2004/0140899 A1 * 7/2004 Bouressa ..... 340/573.1

FOREIGN PATENT DOCUMENTS

DE 33 21 790 A1 1/1985
DE 198 58 022 C2 11/2002

* cited by examiner

*Primary Examiner*—Phung T. Nguyen
(74) *Attorney, Agent, or Firm*—McGlew & Tuttle, PC

(57) ABSTRACT

A device system and a process for monitoring an industrial plant offers the persons working at the plant with the greatest possible protection. Signal transmitters (4, 5), which are fastened to persons (2, 3) or mobile objects, send or trigger a code related to a person or mobile object. Position marks (31, 32, 33, 34, 41, 42, 61, 62, 71, 72, 36, 37, 74), which provide a position code and a direction code for passing through an entrance or an exit, are arranged at entrances and exits of an industrial plant (21, 22). A receiving unit (15, 35, 43, 63, 73) receives the code of the signal transmitters combined with the position code and direction code. A computing and evaluating unit (12) is connected with the receiving unit and generates a topology for the persons or mobile objects to enter or leave the industrial plant.

18 Claims, 2 Drawing Sheets

DEVICE AND PROCESS FOR ENTERING OR LEAVING AN AREA IN A CONTROLLED MANNER

CROSS REFERENCE TO RELATED APPLICATIONS

This application claims the benefit of priority under 35 U.S.C. § 119 of DE 103 47 894.9 filed Oct. 15, 2004, the entire contents of which are incorporated herein by reference.

FIELD OF THE INVENTION

The present invention pertains to a device and a process for entering or leaving an area in a controlled manner.

BACKGROUND OF THE INVENTION

Areas in the form of complex industrial plants normally have means for displaying information on the operation and on the monitoring of the plant. The monitoring comprises, on the one hand, the checking of process parameters and, on the other hand, the detection of accidents, which may develop, for example, because of leaky line systems. Prior-art monitoring systems for industrial plants are devices for measuring gas concentrations, which are arranged stationarily as stationary measuring heads, or they are mobile measuring systems, which are carried by persons. Such a device for measuring gas concentrations has become known from DE 198 58 022 C2. A satellite-supported positioning system GPS (global positioning system) is used to determine the position of the stationary and mobile measuring heads. However, these positioning systems cannot be used in closed spaces, and it is not possible to determine the direction of a movement because of the limited resolution.

Hazardous working areas are secured in industrial plants such that only certain persons can enter them. It is known from DE 33 21 790 A1 that an active or passive transponder is associated with individual pieces of clothing of the persons to be protected. A code, which contains a personal code, can be assigned to this transponder, so that only authorized persons, who carry certain items of equipment provided with transponders, can enter the hazardous areas. The prior-art personal monitoring system comprises no position recognition that would enable a head of operations sitting in a monitoring center to determine the instantaneous position of the employees.

SUMMARY OF THE INVENTION

The basic object of the present invention is to provide a device and a process that make it possible for the persons working in an area to have the greatest possible protection.

According to the invention, a device enabling persons or mobile objects to enter or leave an area in a controlled manner includes signal transmitters, which are fastened to persons or mobile objects and which send or trigger a code related to a person or mobile objects. Position marks are provided at entrances and exits of the area, which provide a position code and a direction code for the passage by an entrance or an exit. A receiving means is provided for receiving the code of the signal transmitters combined with the position and direction code. A computing and evaluating unit is connected with the receiving means and is designed to generate a topology for persons or mobile objects to enter or leave the area.

According to another aspect of the invention, a process is provided for enabling persons or mobile objects to enter or leave an area in a controlled manner. Signal transmitters are fastened to the persons or mobile objects. The signal transmitters send or trigger a code related to the person or mobile objects. Position marks are arranged at the entrances and exits of the area, which provide a position code and a direction code for the passage by an entrance or an exit. A receiving means is provided, which is designed to receive the code of the signal transmitter combined with the position code and the direction code. A topology is generated for the persons or mobile objects to enter or leave the area with a computing and evaluating unit, which is connected with the reception means.

The advantage of the present invention is essentially that individual data sets, comprising a personal code, a position code and a direction code, are generated by signal transmitters located at entrances or exits of the area, and the topology for entering and leaving the area can be determined from these codes in a central computing and evaluating unit. It is thus possible to determine from a central location which persons are present in a corresponding area. The accuracy of the positioning can be increased by arranging additional position marks in the area. The position marks are designed such that they generate both a position code and a direction code, from which the direction in which a person has passed by the position mark can be inferred. Whether a person has entered or left the area can be determined from the direction code. If, for example, a person is only passing by the position mark without entering or leaving the area, no direction code is generated, but it is only recorded that the person is in the vicinity of the position mark.

The position mark for recognizing the direction is designed such that two individual position marks, with which an individual position code is associated, are arranged next to one another, so that the direction can be inferred from the sequence in which the person passed by the individual position marks. The signal transmitters, which communicate with the position marks, are advantageously designed as active or passive transponders. The transponders can be easily accommodated in a chip card carried by the person or in the clip of a gas measuring device being carried.

As an alternative or in addition to persons, mobile objects may also be provided with signal transmitters or transponders.

A central meeting point, at which a position mark communicating with the central computing and evaluating unit is located, is advantageously provided in the area itself or outside the area. If a state of alarm or warning is triggered in the area, the persons located in the area leave the area via the exits. The persons who have passed by and the direction in which they have passed by are recognized by the position marks. However, it may also happen that persons do not leave the area via the exits, but head for safety by another route. There is an instruction for this stating that all persons shall meet at the central meeting point. Using the position mark located at the meeting point, it is possible to determine which persons have reached the meeting point based on the codes sent by the transponders.

The areas are advantageously provided with monitoring means for sending measured signals to the computing and evaluating unit. Means for recognizing and localizing a state of alarm or warning from the measured values are present in the computing unit, and the position data of the individual persons, who are located in the area, are compared with the position of the state of alarm or warning. The computing and evaluating unit then generates an escape signal, with which luminous hands are actuated, which show the way to a safe exit.

In addition to the indication of the escape route, the actuation of door closing mechanisms or ventilators may advantageously also be incorporated in the alarm plan. Thus, only the escape doors that make it possible to leave the building or the industrial plant safely will be unlocked by the computing and evaluating unit in the state of alarm or warning. Escape routes that lead into the hazardous area are blocked. Ventilators that are located at the source of the fire are shut off automatically by the computing and evaluating unit in case of a fire alarm.

The area is advantageously an industrial plant with walkable buildings located therein, wherein position marks are arranged at entrances or exits of the industrial plant and the buildings.

Gas indicator systems and fire alarm systems are provided as monitoring means. Escape routes within the areas are indicated by luminous hands or luminous strips.

An exemplary embodiment of the present invention is shown in the drawings and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figure 1:
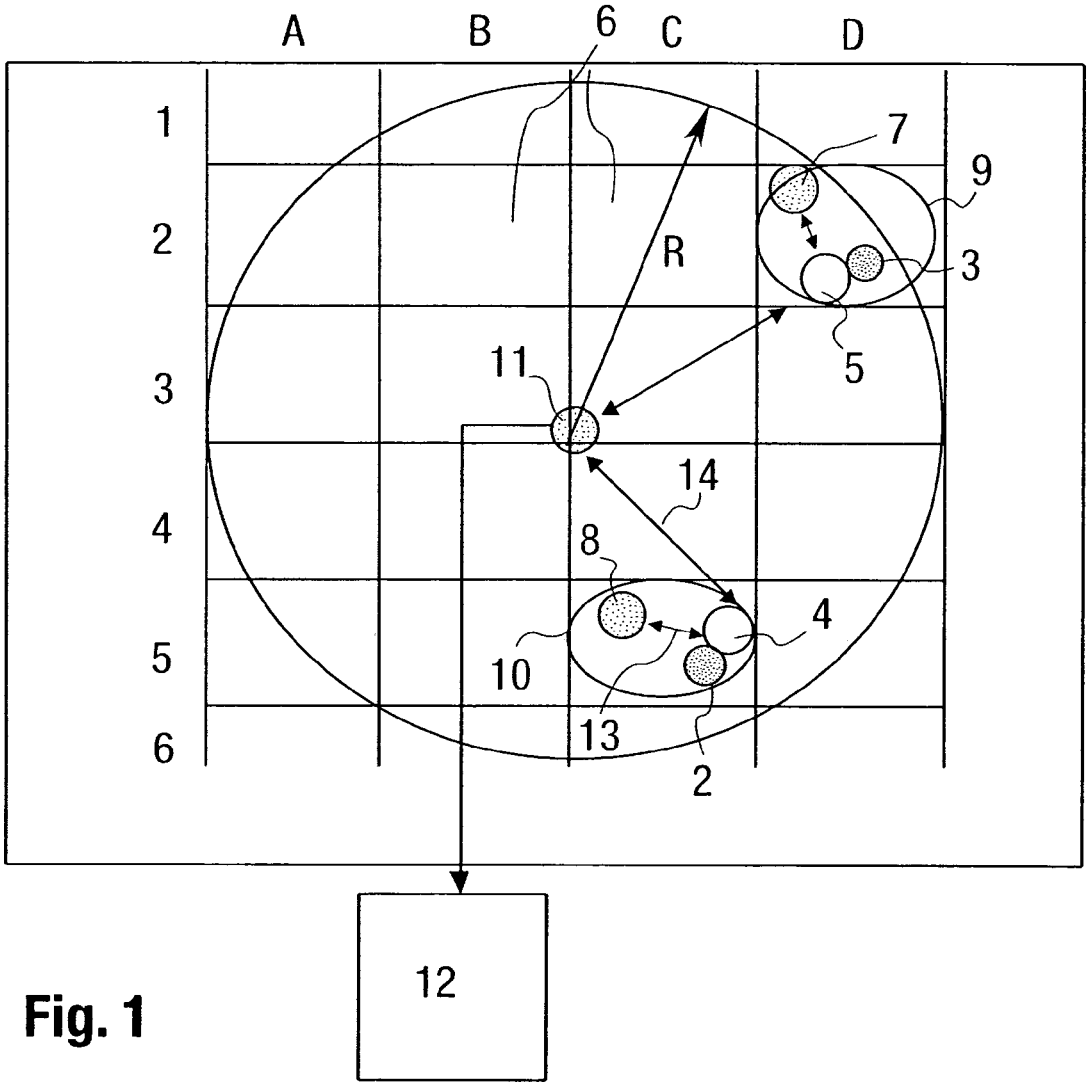
FIG. 1 is a schematic view showing the design of a positioning system.

FIG. 1 schematically shows a positioning system 1 for persons 2, 3, who are not specifically shown in FIG. 1 and are provided with active transponders 4, 5. The area to be monitored extends over a radius of R=50 m, and the area is divided into individual rectangular segments 6. The position of the segments 6 can be indicated by a combination of letters A–D on the abscissa and numbers 1 through 6 on the ordinate.

A first position mark 7 is illustrated as an example in segment 6 "D2" and a second position mark 8 in segment "C5." The other segments 6 are likewise provided with position marks, which are not shown in FIG. 1 for the sake of greater clarity. Each of the position marks 7, 8 has a floor loop 9, 10, which extends over the segment "D2" or the segment "C5." Space coordinates can be stated for the entire area by means of position marks and corresponding floor loops in adjacent fields.

The position marks 7, 8 permanently send coded space coordinates. If the active transponder 4 comes into the area of the floor loop 10 of the position mark 8, it is activated by the carrier frequency imitated via the floor loop 10 and receives the space coordinate of the position mark 8. This space coordinate is transmitted together with an individual code of person 2 to a central reception point 11, which is in connection with a central computing and evaluating unit 12. The data communication for the position mark 8 and the transponder 4 is indicated by arrows 13, 14. The codes for the persons 2, 3 are permanently programmed in the corresponding transponders 4, 5, so that information is present on the instantaneous position of the persons 2, 3 in the computing and evaluating unit 12 at any time on the basis of the space coordinates of the position marks 7, 8.

Figure 2:
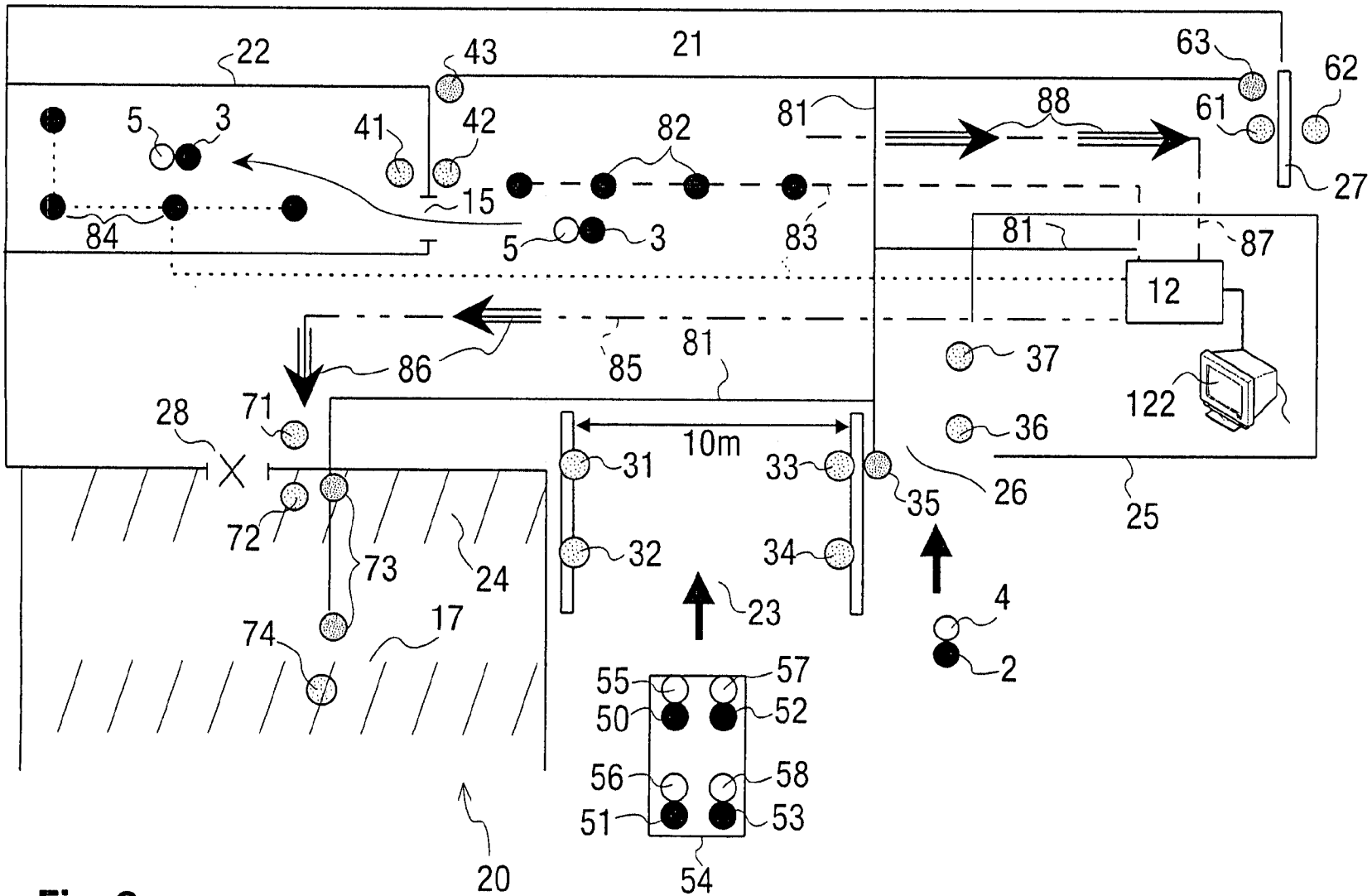
FIG. 2 is a schematic view showing an industrial plant according to the present invention with a positioning system corresponding to FIG. 1.

FIG. 2 schematically shows an industrial plant 20, which comprises a production area 21, a warehouse 22 with an entrance 15, a doorway 23 with an adjacent parking area 24 and an office building 25. There is an entrance 26 for employees between the doorway 23 and the office building 25, and there is an emergency exit 27 behind the office building 25. The parking area 24 can be reached via a turnstile 28 from the production area 21. The entrances and exits of the production area 21 as well as the entrance 15 to the warehouse 22 are provided with position marks. Thus, four position marks 31, 32, 33, 34 with a reception point 35 are located in the area of the doorway 23. The entrance 15 to the warehouse 22 has two position marks 41, 42 with the reception point 43, and the emergency exit likewise has two position marks 61, 62 and a reception point 63, the turnstile 28 has two position marks 71, 72 with a reception point 73, and the entrance 26 has two position marks 36, 37 for the reception point 35.

A position mark 74, which communicates with the reception point 73, is located in the parking area 24 at a meeting point 17. The meeting points 35, 43, 63, 73 are connected with the central computing and evaluating unit 12 via signal lines 81. The positions of the individual position marks and persons are illustrated on a monitor 122 in the form of a topology.

A gas indicator system 82, which responds to toxic gases and sends a warning signal to the computing and evaluating unit 12 via a signal line 83 when a limit value is exceeded, is located within the production area 21. A fire alarm system 84 located within the warehouse 22 is connected with the computing and evaluating unit 12 via the signal line 85.

The monitoring of the industrial plant 20 is carried out as follows:

Person 2 with the transponder 4 enters the production area 21 via the entrance 26. Person 2 now comes into the ranges of action of the position marks 36, 37 one after another. The space coordinates belonging to the position marks 36, 37 and the code of person 2 are transmitted to the reception point 35 and forwarded to the computing and evaluating unit 12. A direction code, which states that person 2 has entered the production area 21, is obtained from the sequence in which the position marks 36, 37 are passed by.

Person 3 with the transponder 5 in the production area 21 wants to perform work in the warehouse 22. To enter the warehouse 22, he passes by the position marks 41, 42 in the order position mark 42 and position mark 41. Together with the code of person 3, which is stored in the transponder 5, and the space coordinates of the position marks 41, 42, the computing and evaluating unit 12 receives information via the reception point 43 that person 3 is located within the warehouse 22.

A passenger car 54 occupied by four persons 50, 51, 52, 53 wants to drive through the doorway 23 to the production area 21. The persons 50, 51, 52, 53 carry personal transponders 55, 56, 57, 58. The transponders 55, 56 are detected by the position marks 32, 31 during the entry into the production area 21, and the transponders 57, 58 come into the range of action of the position marks 34, 33. It is established from the order in which the position marks 32, 31; 34, 33 are passed by and the direction code resulting therefrom that the persons 50, 51, 52, 53 have entered the production area 21 in the passenger car.

An alarm plan for the industrial plant 20 makes provisions for the persons 2, 3, 50, 51, 52, 53 located in the area to come to a meeting point 17 with the position mark 74 in the parking area 24. The persons must pass through the turnstile 28 along the position marks 71, 72 to do so. As an alternative, provisions are made, if the escape route via the turnstile 28 is blocked, for the persons to leave the production area 21 via the emergency exit 27 along the position marks 61, 62.

The gas indicator system 82 reports a gas alarm via the signal line 83 to the computing and evaluating unit 12. Since the gas alarm is from the vicinity of the emergency exit 27, the emergency exit 27 is blocked, and the computing and evaluating unit 12 activates luminous hands 86 showing the escape route via the turnstile 28 via a signal line 85. Persons who pass through the turnstile 28 are detected by the position marks 71, 72 before they reach the meeting point 17 at the position mark 74. Persons who do not pass through the turnstile 28 and leave the production area by other routes, for example, via a fence, are detected by the position mark 74 at the meeting point 17.

In an alternative case of warning, when a fire is reported by the fire alarm system 84 in the warehouse 22, the escape route via the turnstile 28 is blocked, and the luminous hands 88, which show the escape route via the emergency exit 27, are actuated via the signal line 87. It can be determined by means of the position marks 61, 62 at the emergency exit 27 which persons have passed by the emergency exit 27.

If the person 3 is still in the warehouse 22 in case of a fire, the transponder 5 sends the information on whether the person 3 is still in the warehouse 22 or has already left it combined with the position marks 41, 42 and the reception point 43. The computing and evaluating unit 12 can then immediately send an instruction on whether the firefighting operations can be started or whether the person 3 must first be rescued from the warehouse 22. Since it is possible at any time to recognize the whereabouts of persons within and outside buildings at any time, it is possible to immediately decide in case of a warning or alarm which persons must be brought to safety from an area at risk.

While a specific embodiment of the invention has been shown and described in detail to illustrate the application of the principles of the invention, it will be understood that the invention may be embodied otherwise without departing from such principles.

What is claimed is:

1. A device enabling persons or mobile objects to enter or leave an area in a controlled manner, the device comprising:

signal transmitters fastened respectively to persons or mobile objects, said transmitters sending or triggering a code related to a person or mobile objects;

plural position marks at each of the entrances and at each of the exits of the area, said plural position marks providing a position code and a direction code for the passage by an entrance or an exit;

a receiving means for receiving the code of the signal transmitters combined with the position and direction code; and a computing and evaluating unit connected with the receiving means and designed to generate a topology for persons or mobile objects to enter or leave the area.

2. A device in accordance with claim 1, further comprising a central meeting point position mark provided at a central meeting point, said receiving means being connected with the computing and evaluating unit for receiving the code of the persons or objects located in the range of action of said central meeting point position mark.

3. A device in accordance with claim 1, wherein the area is provided with monitoring means for sending measured signals to said computing and evaluating unit, said computing and evaluating unit having means for recognizing and localizing a state of alarm or warning from the measured signals, and said computing and evaluating unit having comparison means for comparing the position data of the persons or objects within the area with the position of the monitoring means triggering the state of alarm or warning and for generating a escape signal showing the escape route.

4. A device in accordance with claim 3, wherein the monitoring means comprise a gas indicator system and a fire alarm system.

5. A device in accordance with claim 1, wherein the area is an industrial plant with walkable buildings located therein.

6. A device in accordance with claim 5, wherein the position marks are arranged at said entrances and exits of the industrial plant and the buildings.

7. A device in accordance with claim 1, wherein said plural position marks are physically arranged to generate directional information to form said direction code.

8. A process for enabling persons or mobile objects to enter or leave an area in a controlled manner, the process comprising the steps of:

fastening signal transmitters to persons or mobile objects, the signal transmitters sending or triggering a code related to the person or mobile objects;

arranging plural position marks at the entrances and exits of the area to provide a position code and a direction code for the passage of signal transmitters by an entrance or an exit;

providing receiving means receiving the code of the signal transmitter combined with the position code and the direction code; and generating a topology for the persons or mobile objects to enter or leave the area with a computing and evaluating unit, which is connected with the reception means.

9. A process in accordance with claim 8, further comprising providing a central meeting point position mark provided at a central meeting point, said receiving means being connected with the computing and evaluating unit and transmitting the code of said persons or mobile objects located in the range of action of the central meeting point position mark.

10. A process in accordance with claim 8, wherein the area is provided with monitoring means sending measured signals to the computing and evaluating unit and states of alarm or warning are localized from the measured signals, the position data of the persons or mobile objects and the site of the state of alarm or warning are compared such that an escape route is shown to one or more exits.

11. A process in accordance with claim 8, further comprising physically arranging each plurality of position marks to generate directional information to form said direction code.

12. A system for monitoring an area, the system comprising:

a transmitter fastened to a person or a mobile object, said transmitter sending or triggering a code related to the person or the mobile object;

a plurality of position marks at the entrances and a plurality of position marks at the exits of the area, said position marks providing a position code and together cooperating to provide a direction code for the passage of the transmitter by an entrance or an exit;

a receiving unit receiving the code of the signal transmitters combined with the position and direction code; and a computing and evaluating unit connected with the receiving means and providing information as to persons or mobile objects entering and/or leaving the area.

13. A system in accordance with claim 12, further comprising a central meeting point position mark provided at a central meeting point, said receiving means being connected with the computing and evaluating unit for receiving the code of the persons or objects located in the range of action of said central meeting point position mark.

14. A system in accordance with claim 12, wherein the area is provided with monitoring means for sending measured signals to said computing and evaluating unit, said computing and evaluating unit having means for recognizing and localizing a state of alarm or warning from the measured signals, and said computing and evaluating unit having comparison means for comparing the position data of the persons or objects within the area with the position of the monitoring means triggering the state of alarm or warning and for generating a escape signal showing the escape route.

15. A system in accordance with claim 14, wherein the monitoring means comprise a gas indicator system and a fire alarm system.

16. A system in accordance with claim 12, wherein the area is an industrial plant with walkable buildings located therein.

17. A system in accordance with claim 16, wherein the position marks are arranged at said entrances and exits of the industrial plant and the buildings.

18. A device in accordance with claim 12 , wherein said plural position marks are physically arranged to generate directional information to form said direction code.

* * * * *